US010174963B2

(12) United States Patent
Zhang

(10) Patent No.: US 10,174,963 B2
(45) Date of Patent: Jan. 8, 2019

(54) SMART BUILDING HVAC ENERGY MANAGEMENT SYSTEM

(71) Applicant: Qin Zhang, Los Angeles, CA (US)

(72) Inventor: Qin Zhang, Los Angeles, CA (US)

( * ) Notice: Subject to any disclaimer, the term of this patent is extended or adjusted under 35 U.S.C. 154(b) by 412 days.

(21) Appl. No.: 15/190,201

(22) Filed: Jun. 23, 2016

(65) Prior Publication Data

US 2017/0167747 A1 Jun. 15, 2017

Related U.S. Application Data

(60) Provisional application No. 62/231,058, filed on Jun. 23, 2015.

(51) Int. Cl.

| | |
|---|---|
| ***F24F 11/30*** | (2018.01) |
| ***F24F 3/00*** | (2006.01) |
| ***F24F 3/052*** | (2006.01) |
| ***F24F 3/048*** | (2006.01) |
| ***F24D 19/10*** | (2006.01) |
| ***F24F 11/70*** | (2018.01) |
| *F24F 11/46* | (2018.01) |

(52) U.S. Cl.
CPC ..... *F24F 11/30* (2018.01); *F24D 19/1084* (2013.01); *F24F 3/001* (2013.01); *F24F 3/048* (2013.01); *F24F 3/052* (2013.01); *F24F 11/70* (2018.01); *F24F 11/46* (2018.01)

(58) Field of Classification Search
None
See application file for complete search history.

(56) References Cited

U.S. PATENT DOCUMENTS

2014/0048244 A1* 2/2014 Wallace ..... F28F 27/00 165/253
2014/0088945 A1* 3/2014 Davis ..... G06F 17/5004 703/13

* cited by examiner

*Primary Examiner* — Mohammad Ali
*Assistant Examiner* — Saad M Kabir

(57) ABSTRACT

The present invention relates to a system and method of HVAC (Heating, Ventilating, Air Conditioning) energy management system. More specially, the present invention provides a system and method that can provide automatic optimized control mechanism for HVAC system to save energy.

20 Claims, 5 Drawing Sheets

SMART BUILDING HVAC ENERGY MANAGEMENT SYSTEM

CROSS REFERENCE TO RELATED APPLICATIONS

The present application claims the benefit of and incorporate in full the provisional application entitled "Smart Building HVAC Energy Management System" with Application No. 62/231,058 filed on Jun. 23, 2015.

FIELD OF INVENTION

The present invention relates to a system and method of HVAC (Heating, Ventilating, Air Conditioning) energy management system. More specially, the present invention provides a system and method that can provide automatic optimized control mechanism for HVAC system to save energy.

BACKGROUND OF THE INVENTION

Energy consumptions of HVAC systems for buildings are significant portions of overall energy consumptions. Therefore, energy management systems for HVAC systems that could significantly reduce energy consumption will be very useful. However, most of the energy management systems are basically monitoring systems, rely heavily on human interventions for actual management and controls. There are few optimized energy control systems based on automatic control sequence to specifically control system operating conditions.

For example, U.S. Pat. No. 9,026,261, "Methods and systems for managing energy usage in buildings" mostly disclosed energy usage monitoring and data recording systems. U.S. Pat. No. 8,235,776, "Fully articulated and comprehensive air and fluid distribution, metering, and control method and apparatus for primary movers, heat exchangers, and terminal flow devices" and U.S. Pat. No. 7,216,698, "Air-conditioning system" failed to provide comprehensive automatic control logic to achieve automatic control. U.S. Pat. No. 7,216,021, "Method, system and computer program for managing energy consumption" mostly provide operation data analysis but failed to provide actual workable operation logic for daily operations.

SUMMARY OF THE INVENTION

An exemplary building HVAC system to be controlled by the present invention includes a hot water distribution system 10, a hot water generating system 11, a chilled water distribution system 12, a chilled water generating system 13, and a plurality of air distribution systems 14.

A system and method for a complete HVAC system control and management comprises a data intake module 800, a data storage module 810, a process module 820 and a control module 830. The data intake module 800 taking information from data input by manual inputs, and by receiving signals from sensors placed in the HVAC system. The data storage module 810 stores operation data and related data in a HVAC operation database. The process module 820 processes data from intake module 800 and data storage module 810 and sending output information to the control module 830. The control module 230 controls equipment in the HVAC system such as fans, pumps, dampers and valves.

BRIEF DESCRIPTION OF THE DRAWINGS

The above and further features and advantages of the present invention may be appreciated from the detailed description of preferred embodiments with reference to the accompanying drawings, in which.

DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

An embodiment of the present invention is now described with reference to the accompanying drawings.

An exemplary building HVAC system related to the present invention includes a hot water system 10, a chilled water system 12, a chilled water ancillary system 13, and a plurality of air distribution systems 14.

Figure 1:
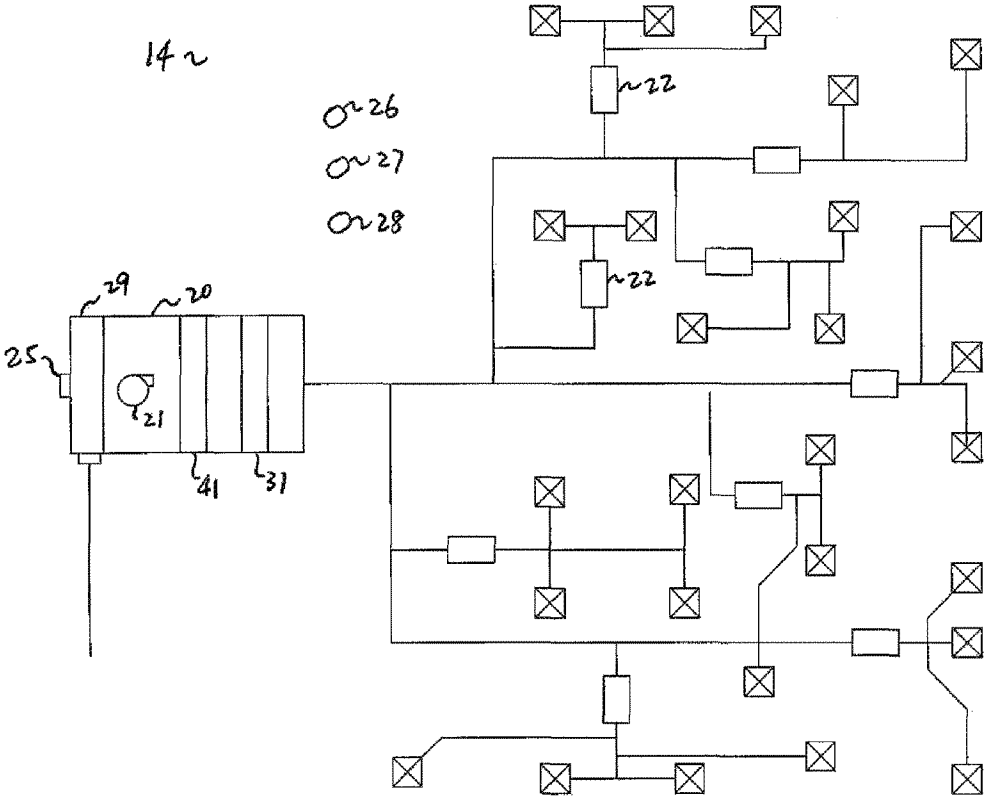
FIG. 1 is a schematic illustration of one exemplary air distribution system of the building air conditioning system.

As illustrated in FIG. 1, each air distribution system 14 includes an air conditioning unit 20, more than one VAV (Variable Air Volume) boxes 22, supply air distribution ducts, return air ducts (not shown completely), control dampers 24 (not shown, can be used as alternative to VAV boxes), and air distribution terminal devices such as supply air grills and return air grills (not shown). Each of the air conditioning unit 20 is connected to air distribution terminal devices through supply air ducts, and return air ducts. The air distribution systems 14 are also equipped with thermostats with temperature sensors 26 for sensing actual room temperatures and meanings to adjust set point (Tr) for room temperatures. Alternatively, the air distribution system 14 can be equipped with temperature sensors 26 only, and set point (Tr) for room temperatures can only be controlled at the central control station (set at fixed point, or can be a part of data input of the system). The thermostats or temperature sensors generally are corresponding with VAV boxes 22 or control dampers 24, meaning one thermostat or temperature sensor for each VAV boxes or control damper.

The each of air distribution system 14 can also be equipped with a flow measuring device 23 such as flow meter or as part of the VAV box near (or in) each of the VAV box 22, or near each of the control damper 24.

The air distribution system may further include an outside air intake control damper 25, humidity sensors 27, and Co2 sensors 28.

Each air conditioning unit 20 also includes a heating coil 31 and a cooling coil 41, and at least one fan 21 for moving air in the distribution system 14. The air conditioning unit 20 can also be equipped with an economizer 29.

Figure 2:
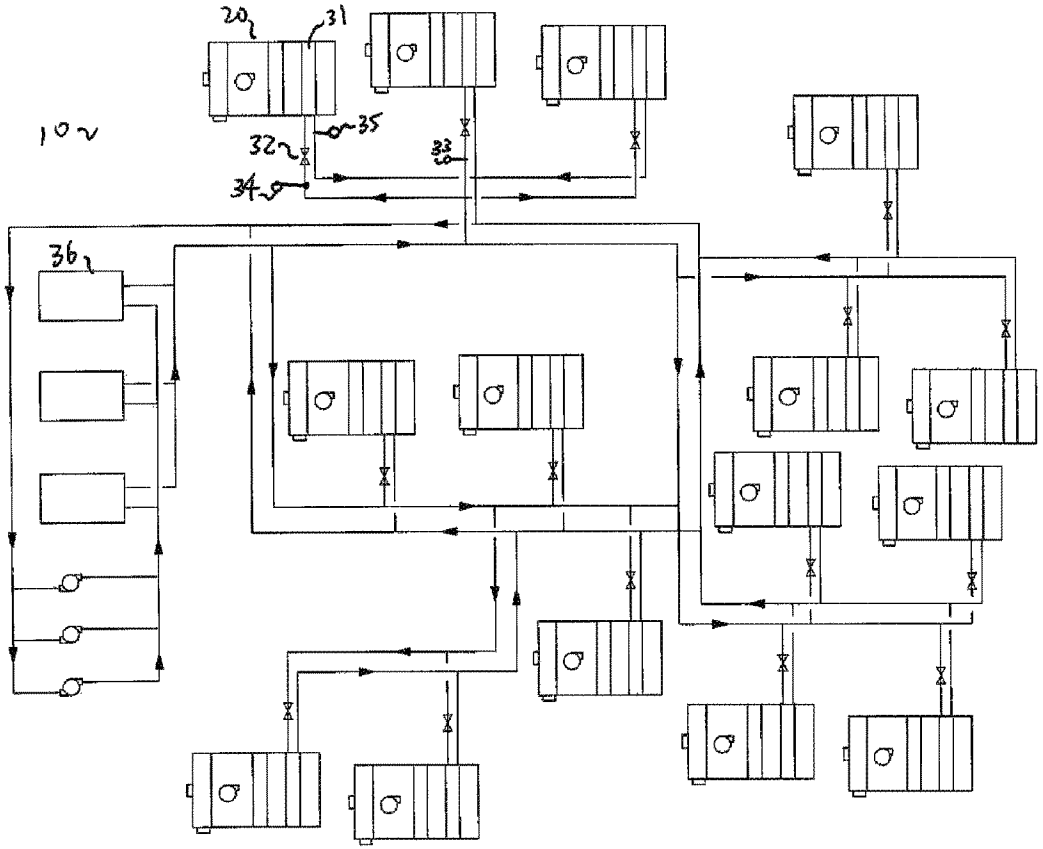
FIG. 2 is a schematic illustration of one exemplary hot water distribution system of the building air conditioning system.

As illustrated in FIG. 2, the hot water system 10 includes one or more pumps 30, one or more boilers 36, connected with pipe lines, to heating coils 31 of air handling units 20. The hot water system 10 also includes control valves 32 located near each heating coil 31 of each air handling unit 20. The hot water system 10 is equipped with temperature sensing devices (such as temperature sensors) 34 and 35 for sensing supply and return water temperature for each heating coil 31 for each air handling unit 20. The hot water system 10 can also be equipped with a flow measuring device 33 such as flow meter for each of the heating coil 31.

Figure 3:
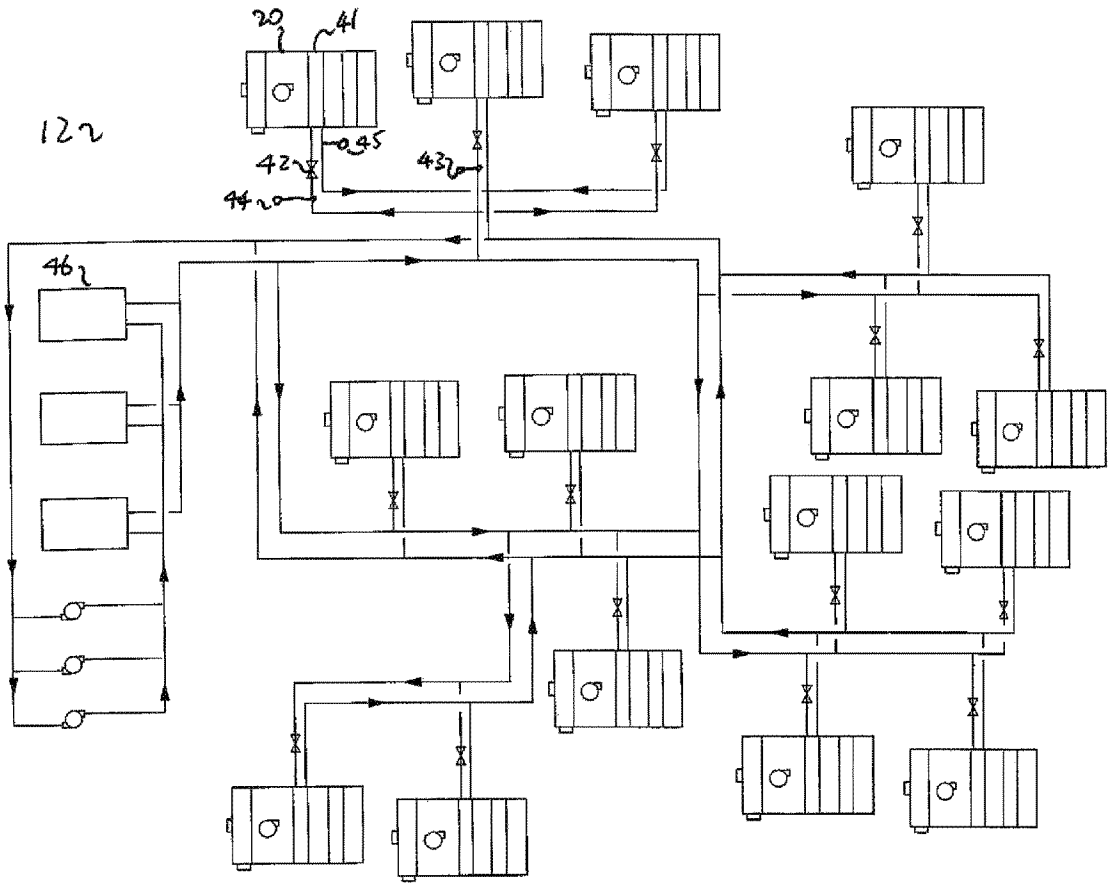
FIG. 3 is a schematic illustration of one exemplary chilled water distribution system of the building air conditioning system.

As illustrated in FIG. 3, the chilled water system 12 includes one or more pumps 40, one or more chillers 46, connected with pipe lines, to cooling coils 41 of air handling units 20. The chilled water system 12 also includes control valves 42 located near each cooling coil 41 of each air handling unit 20. The chilled water system 12 is equipped with temperature sensors 44 and 45 for sensing supply and return water temperature for each cooling coil 41 of each air handling unit 20. The chilled water distribution system 12 can also be equipped with a flow measuring device 43 such as flow meter for each of the heating coil 41.

A pair of temperature sensing devices 50 and 51 (such as temperature sensor) and a flow measuring device 52 such as flow meter can be provided for each chiller. A control valve 53 can be provided for each chiller corresponding to the temperature sensing device 50 and 51 and flow measuring device 54.

Figure 4:
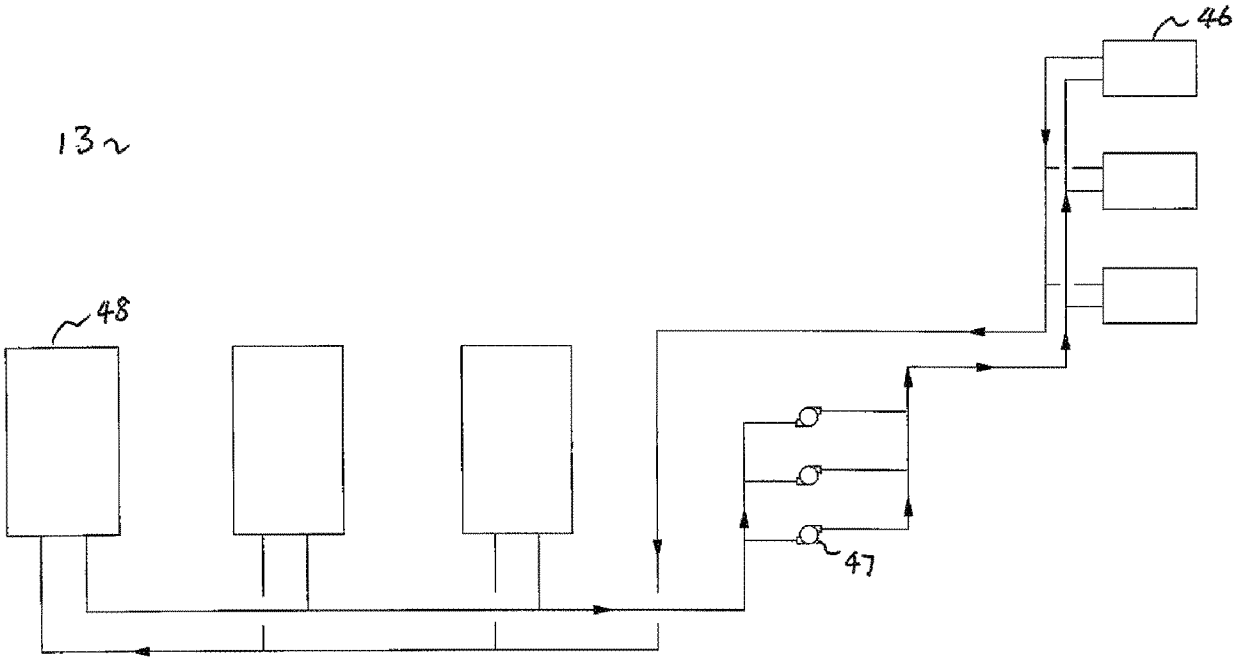
FIG. 4 is a schematic illustration of one exemplary chilled water ancillary system of the building air conditioning system.

As illustrated in FIG. 4, a chilled water ancillary system 13 includes one or more pumps 47, one or more chillers 46, one or more cooling towers 48, that are connected to pumps 47 with pipe lines.

A pair of temperature sensing device 55 and 56 (such as temperature sensor) and a flow measuring device 57 such as flow meter can also be provided for each chiller 47 and cooling tower 48 in the chiller-cooling tower loop. A control valve 57 and control valve 58 can be provided for each chiller 47 and cooling tower 48 corresponding to the temperature sensing device 55 and 56, and flow measuring device 57.

Figure 5:
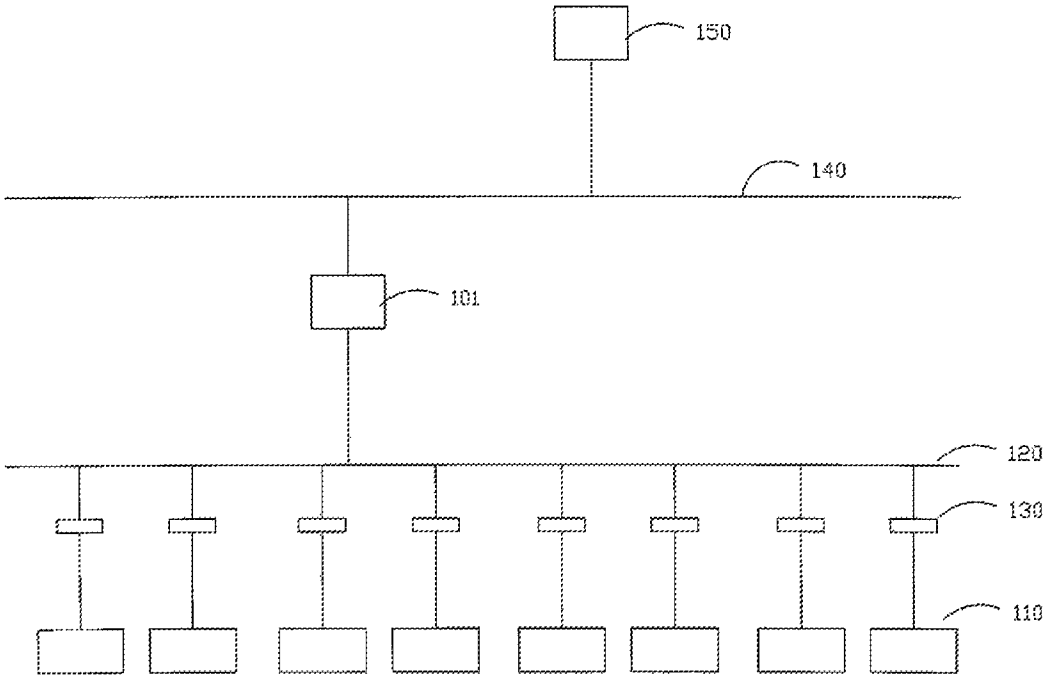
FIG. 5 is a schematic illustration of one preferred embodiment of the computer hardware implication of the system of the present invention.

FIG. 5 is a schematic diagram illustrating an exemplary hardware structure of a preferred embodiment of present invention for building HVAC Energy Management System. In facility with one or more buildings, an Energy Management System (EMS) center server 101 in charge of conducting energy management is electrically connected to one or more controllers 110 through a building communication line 120.

The EMS center server 101 can include devices for connecting to and receiving information from data inputting devices (such as keyboard) and controllers 110, devices for connecting to (and receiving information from) and sending information to data displaying devices (such as monitors), devices for connecting to and sending information to) data outputting devices and controllers 110, data storage devices and data exchange devices, and data processing devices.

The EMS center server 101 can gathers information on operation of the HVAC system in the facility and control the operation of the through controllers 110. The controllers 110 can be connected to EMS center server 101 through building automation communication line 120. In one preferred embodiment of the present invention, a switch 130 is provided for each controllers 110 connecting to the building communication line 120. Alternatively, one type of controllers can perform information gathering function, while another type of controllers can perform control function of the system. In one preferred embodiment of the present invention, the building communication line 120 can be part of the Ethernet network.

The EMS center server 101 also serves as a gateway between the internet 130 and the building communication line 120.

The Energy Management System for HVAC system may be part of overall building energy management system include other types of controllers or control mechanism that can be connected to a general power supply system, or a system for appliances, a lighting system, a disaster prevention system, a security system, an elevator system and an environment monitoring system, etc.

Information of the operation of HVAC system provided by sensing devices such as sensors and metering devices that are placed in the HVAC system and the building environment is in the form of electronic signals, either analog or digital, while controllers 110 can convert analog signals to digital signals. The controllers 110 send all signals received from sensing devices to the EMS center server 101 via the BA communication line 120.

Control signals are sent by the EMS center server 101 to each of the controllers 110 via the building communication line 120, to control movable devices in HVAC system, such as fans, pumps, control dampers, and control valves.

A remote control server 150, which is also electrically connected to the internet 140, is able to communicate with the EMS center server 101.

The EMS center server 101 includes a HVAC operation database, which can include all the information related to the operation of the HVAC system.

The HVAC operation database can include information related to facility structure which includes data associated with the buildings to be controlled, such as building IDs, types for the buildings, names for peculiar buildings, and zones within the buildings. The HVAC operation database can further include information related to HVAC systems within each building, such as HVAC system IDs, types of HVAC systems, HVAC equipment and device IDs, types of the HVAC equipment and devices, etc. Preferably, these information can be received from inputting devices in system initial setup process, can be revised through inputting devices.

Preferably, the HVAC operation database can be organized based on building information, HVAC system information, HVAC equipment and device information, and operation time or real time.

The HVAC operation database can include other information for the equipment and devices, for example, information for year-month-date of installation, a control method, a rated capacity, characteristics, a manufacturer, attachments, special notes, a covering area.

The HVAC operation database can also include design condition information for various measuring points, which can be correlated with sensing device information. For example, for each flow measuring device such as flow meter, the reading of the flow meter when the HVAC system is operating at design condition can be inputted as initial system setup information.

The HVAC operation database can also include operation information received from the controllers 110, including an ID of received information, a name (or type) of received information (such as temperature, flow rate, etc.) and the received information corresponding to operation time or real time. The received information can be related to and organized based on building information, HVAC system information, HVAC equipment and device information, based on the controller and sensor information, and initial system set up.

The HVAC operation database can also include information related to control data sent to the controllers 110 from the EMS center server 101, including an ID for the control information, a name for control information sending to controllers 110, and the control information corresponding to operation time or real time. The control information can be related to and organized based on building information, HVAC system information, HVAC equipment and device information, based on the controller information, and initial system set up.

Meteorological information can also be included in the HVAC operation database, inputted manually, or downloaded from weather information source. Meteorological information is organized according to time, and can be corresponding to operation data accordingly. For example, control data corresponding to certain meteorological information at certain time can be used when later meteorological information resemble the certain meteorological information.

The HVAC operation database can also provide HVAC system operation conditions by providing direct correlations between temperatures, flow rates, dampers and valves positions, and fan and pump speeds, etc. by reading and storing all operating related data at particular time (and/or per system requests), and corresponding to time.

The EMS center server 101 can provide an inputting means in a user interface device for inputting system setup information. The data input can be in fill out form format, or in document format. The inputted information will be saved into the HVAC operation database.

Detailed steps carried out by a HVAC EMS system 100 for managing HVAC system operation according to the present invention is described below.

Initial System Calibration

In one preferred embodiment of the present invention, the HVAC EMS system 100 perform the task of "Initial System Calibration", to adjust the speed of fans 21 (or pumps 36 or 40) in air distribution system 14 (or hot water distribution system 10 or chilled water distribution system 12) to be within the margin of "design condition".

HVAC system operation is guided by design documents requiring the system capable of meeting the design conditions. However, this design condition usually is not automatically achievable at initial system setup during to various reasons such as excess capacity of the fans or pumps, variations of the air ducts (or water pipes) and fittings with the design values, etc. Therefore, it is possible that the fans or pumps can run at less than full capacities to meet the design condition.

In one preferred embodiment of the present invention, an process for controlling a chilled water distribution system 12 is provided as following:

In step 200, the EMS center server 101 sends control signals to set all control valves 42 to "wide open" or indexed to maximum positions with no unintended obstruction, and starting all pumps operating in maximum capacity.

In step 201, the EMS center server 101 reads all inputting information received from flow meters 43, and comparing the information with design conditions. All readings of inputting information received from flow meters 43 are saved in the HVAC operation database.

If all readings are higher than design conditions (exceeding the preset margin), then continue to step 202.

If there are readings that are lower than design condition (exceeding the preset margin), then continue to step 206.

In step 202, the EMS center server 101 sends signal to VFD drive (or similar control devices to control operation of the pumps) to reduce speeds of pumps with a preset margin.

In step 204, the EMS center server 101 reads all inputting information received from flow meters 43, and comparing the information with previous readings to determine if the system is stabilized after the adjustment of speeds of fans and pumps. All readings of inputting information received from flow meters are saved in the HVAC operation database.

This step can be performed in a preset time margin repeatedly, until it is determined that the system is stabilized. For example, the EMS center server 101 can performed step 204 every 5 minutes, and determine the system is stabilized if all the subsequent readings are within 5% margin of difference with the prior readings. All the time margins and differential margins can be inputted in the EMS system setup stage, correlated to HVAC system information.

Once it is determined that the system is stabilized, the EMS center server 101 repeats the steps of 201 to 204, until one of readings in the chilled water distribution system 12 are within the acceptable margin of the design condition. For example, if the design condition correlating to a flow meter is 10 GPM, and the acceptable margin for this calibration process is 5%, then when a reading from a flow meter is 10.5 GPM, the calibration process is completed.

However, if a reading from the chilled water distribution system 12 is that are lower than design condition (exceeding the preset margin), step 206 will be activated.

In step 206, the EMS center server 101 sends signal to VFD drive (Variable Frequency Drive, or similar control devices to control operation of the fans and motors) to increase speeds of pumps with a preset margin. Then proceed to step 204.

Steps 200 to 206 can be identified as the initial system calibration process, as it adjusts the pump speeds to a value necessary to assure all design conditions are met. The same process can be performed by EMS center server 101 to control hot water distribution system 10, and air distribution system 14.

Initial System Balancing

In another preferred embodiment of the present invention, the HVAC EMS system 100 perform the task of "Initial System Balancing", to adjust the control valves (for hot water distribution system 10 or chilled water distribution system 12) or dampers (for air distribution system 14) for maintaining the flow rate at each flow meter reading within the margin of "design condition". This margin can also be inputted as part of the EMS initial system setup.

In air distribution system and water distribution systems with various branches, the variations between readings with design conditions in various branches after the calibration process of step 200 to 206 can be greater than acceptable. "Initial System Balancing" steps for a chilled water distribution system 12 are as following:

In step 300, the EMS center server 101 reads and compares all inputting information received from flow meters 43 with the correlating design conditions.

If there are reading that are lower than design condition (exceeding the preset margin), then continue to step 306.

If all readings are higher than design conditions (exceeding the preset margin), then finds the "worst case scenario"

in the chilled water distribution system 12 and continue to step 302. All readings of inputting information received from flow meters 43 are saved in the HVAC operation database.

In one preferred embodiment of the present invention, a formula for obtaining the "worst case scenario" in the system is provided: Max [(Vr−Vd)/Vd], where Vr is the actual flow rate reading from a flow meter, and Vd is the design condition correlating to the flow meter.

In step 302, the EMS center server 101 sends signal to control valve 42 (or similar control devices to control the flow in the system) correlating to the flow meter 43 of the "worst case scenario" to close the control valve 42 at certain set margin. This set margin can also be preset at EMS system initial setup.

In step 304, the EMS center server 101 reads all inputting information received from flow meters 43, and comparing the information with previous readings to determine if the system is stabilized after the adjustment of control valves 42. All readings of inputting information received from flow meters 43 are saved in the HVAC operation database.

Once it is determined that the system is stabilized, the EMS center server 101 repeats the steps of 300 to 304, until all of the flow meter readings are within the acceptable margin of the design condition.

At the completion of these processes, the chilled water distribution system 12 is calibrated and balanced to operate at design condition (or near design condition, as it will be difficult to operate completely at the design condition, some variations and imbalances will still exist, depending on the set margins). The same process can be performed by EMS center server 101 to control hot water distribution system 10, and air distribution system 14.

Partial Load

In another preferred embodiment of the present invention, the HVAC EMS system 100 perform the control in "Partial Load" condition, to adjust the pumps (for hot water distribution system 10 or chilled water distribution system 12) or fans (for air distribution system 14) for maintaining the temperature at temperature sensor reading within the margin of "design condition". This margin can also be inputted as part of the EMS initial system setup.

Almost no HVAC system operates at design condition. Or, we can say HVAC systems operate at "Partial Load" most of the time. So, control the system at "partial load" is very important for saving energy.

This type of control process can be applied to VAV system for air distribution, and water distribution system, including hot water distribution system and chilled water distribution system.

Traditionally, VAV system is controlled by temperature sensor at each zone served by the VAV box. When a sensor sensed the room temperature is lower than set point, a control signal will be sent to the VAV box close down the damper in the VAV box, so that the air flow supplied by the VAV box will be reduced. The fan controls of Air Handling Units for VAV systems mostly focus on maintaining certain constant static pressure at some arbitrarily selected point in the distribution system, commonly by a single static sensor placed approximately ⅔ into the system.

But closing down the dampers in VAV boxes mostly will increase the system overall resistance, and maintaining constant system static pressure at set point also mean fan speeds required for the operation will not be greatly reduced, thus less energy saving. In addition, this control method provides no assurance that desired air distributions can be achieved.

The water distribution systems (hot water and chilled water) are facing the same problem. Traditionally, air handling units for VAV systems are paired with control valves in water distribution systems, hot water system and chilled water system. The control valves are controlled by temperature sensors sensing the return air of the Air Handling Units. The pumps for the water distribution systems are generally controlled by maintaining certain pressure drops in the supply and return pipes at certain set point of the system. Again, closing control valves mostly will increase the overall system pressure requirement, and there is not clear assurance that maintaining certain pressure drops in the supply and return pipes at certain set point of the system will provide adequate water supply to each Air Handling Unit.

In a preferred embodiment of the present invention, VAV systems are controlled mostly by controlling the fan speed directly responding to temperature readings. The same mechanism is used in water distribution systems, wherein temperature readings of the return water lines of the Air Handling Units will be used to control pump speeds. This control process may provide the best performance after the HAVC system are adjusted by the "Initial Calibration" and "Initial Balance". "Partial Load" steps for controlling a chilled water distribution system 12 are as following:

In step 400, for VAV (Variable Air Volume) system controls, the EMS center server 101 reads all inputting information received from room temperature sensors of all zones and compares the information with various set points of each zones. All readings of inputting information received from temperature sensors are saved in the HVAC operation database.

Generally speaking, as the system rarely operate exceeding design condition (meaning design conditions are meant to be "worst case scenario"), the room temperatures when the system is running at design flow condition should be lower than desired room temperatures when the system is in cooling mode (when the system is in heating mode, the room temperatures should be higher than desired room temperatures). If this is the case, then continue to step 402.

If the room temperatures when the system is running at design flow condition is higher than desired room temperatures when the system is in cooling mode (When the system is in heating mode, the room temperatures are lower than desired room temperatures), then continue to step 406.

For water distribution system controls, the EMS center server 101 reads all inputting information received from temperature sensors at return water lines for heating coils or cooling coils of the air handling units and comparing the return water temperature with the set points. (For example, the return water temperature for hot water distribution system could be 90 degree Fahrenheit, and return water temperature for chilled water distribution system could be 48 degree Fahrenheit.) These set points can also be inputted into HVAC operation database in EMS system initial setup. All readings of inputting information received from temperature sensors can be saved in the HVAC operation database.

Generally speaking, as the system rarely operate exceeding design condition (meaning design conditions are meant to be "worst case scenario"), the return water temperature when the system is running at design flow condition should be lower than the set point when the system is in cooling mode (When the system is in heating mode, the return water temperatures should be higher than the set point). If this is the reading, then continue to step 402.

If the return water temperature when the system is running at design flow condition is higher than set point when the system is in cooling mode (When the system is in heating mode, the return water temperature are lower than set point), then continue to step 406.

In step 402, the EMS center server 101 sends signal to VFD drive (or similar control devices to control operation of the fans and motors) to reduce speeds of fans or pumps In one preferred embodiment of the present invention, when reducing fan speed in VAV system, outside air damper should be adjusted (opening up) (and/or damper in return air duct to close up in certain margin) to maintain minimum fresh air intake.

In step 404, the EMS center server 101 reads all inputting information received from temperature sensors, and comparing the information with previous readings to determine if the system is stabilized after the adjustment of speeds of fans or pumps. All readings of inputting information received from temperature sensors can be saved in the HVAC operation database.

Once it is determined that the system is stabilized, the EMS center server 101 compares the reading with the set point, and repeating the steps of 400 to 404 (406), until the temperature sensor readings are within the acceptable margin of the set point.

In step 406, the EMS center server 101 sends signal to VFD drive (Variable Frequency Drive, or similar control devices to control operation of the fans or pumps) to increase speeds of fans or pumps at set margin. Then goes back to step 404.

In one embodiment of the present invention, the temperature readings in the air distribution systems and water distribution systems will only be used to control fan speeds, and the EMS system will not rebalance the air distribution system or water distribution system responding to return air or return water temperature changes.

In another embodiment of the present invention, the temperature readings in the air distribution systems and water distribution systems will not only be used to control fan speeds. The EMS system will rebalance the systems responding to return air or water temperature changes. The following steps are continuation of the process of step 400 to 406:

In step 500, the EMS center server 101 reads all inputting information received from temperature sensors, and compares with the design conditions to find the "worst case scenario" in the system. All readings of inputting information received from temperature sensors can be saved in the HVAC operation database.

In one preferred embodiment of the present invention, a formula for obtaining the "worst case scenario" in the system is provided: Max [(Tr−Ts)/Ts], where Tr is the actual temperature of the system, and Ts is the system set point for return temperature.

In step 502, the EMS center server 101 sends signal to control dampers or control valves (or similar control devices to control the flow in the system) to close the control dampers or control valves as certain set margin.

In step 504, the EMS center server 101 reads all inputting information received from temperature sensors, and comparing the information with previous readings to determine if the system is stabilized after the adjustment of control dampers or control valves.

Once it is determined that the system is stabilized, the EMS center server 101 compare the reading with the design condition, and repeating the steps of 500 to 504, until all of the system readings are within the acceptable reign of the design condition.

Depending on the system layout and the range of the fan speed and pump speed, it might be possible that as the result of the adjustment process from steps 500 to 504, there are readings from the temperature sensors that are below the design condition, then in step 506, the EMS center server 101 can send signal to control dampers or control valves (or similar control devices to control the flow in the system) to open the control dampers or control valves as certain set margin and continue with step 504 and so forth. Details of this process are similar to steps 300-306, and with steps 500-506.

The control process of "partial load" can also be conducted based on readings from humidity sensors, Co2 sensors, or sensors measuring other conditions, and compares with design conditions in the same manner.

There are other factors that could affect the HVAC system operation, that could set restrictions on the control process. For example, the boilers and chillers could require minimum flow rate to maintain operation condition, or maintain certain efficiency requirement. Thus the control process may include a set point for minimum flow rate that prevent the pumps from running below the set point conditions.

There are many variations of HVAC systems. There are primary-secondary systems that basically separate hot or chilled water distribution systems from hot or chilled water generation system. And, there are package air handling units that do not require hot water or chilled water supply. However, the control process of the present invention can be used for these system as well that the basic principles for these systems are the same or similar to the systems in the present invention. For example, for the VAV system with package air handling units, all control processes illustrated here can used. For water distribution systems that have primary-secondary configuration, the control processes illustrated here can used for primary system, and the minimum flow rate in the primary system may be further reduced.

Chilled water ancillary system can also be controlled with the same principle as the present invention.

For VAV air distribution system with multiple air terminal devices for each VAV box, each air terminal device is provided with a volume air damper (not shown in FIG. 1), and air balancing of each air terminal device is done manually prior to the process as illustrated in the present invention.

The method and system of present invention can be used to control other system than have similar configuration.

What is claimed is:

1. A method for operating a control system for a fluid system including at least one server, more than one flow measuring devices, more than one controllers for controlling more than one flow control devices, at least one control means to control at least one fluid pressurizing devices, and means for connecting the controllers and control means to the server, comprising the steps of:

(a) the server sending control signals to controllers to set flow control devices to maximum positions, and starting all fluid pressurizing devices operating in maximum capacity;

(b) the server reading all inputting information received from flow measuring devices, and comparing the information with design conditions, and saving inputting information received from flow measuring devices in an HVAC operation database;

wherein if all readings are higher than design conditions exceeding the preset margin, then continuing to step (c);

wherein if at least one readings are within design conditions, then continuing to step (f);

wherein if there are readings that are lower than design condition exceeding the preset margin, then continue to step (e);

(c) sending signal from the server to the control means to reduce speeds of fluid pressurizing devices with a preset margin;

(d) reading all inputting information received from the flow measuring devices, and comparing the information with previous readings to determine if the system is stabilized after the adjustment of speeds of fluid pressurizing devices; and saving all readings of the inputting information received from the flow measuring devices in the HVAC operation database; repeating step (d) until the system is stabilized, then returning to step (b);

(e) the server sending signal to control means to increase speeds of fluid pressurizing devices with a preset margin; and returning to step (d);

(f) the server sending output to indicate the completion of the process.

2. A method as claimed in claim 1, further comprising the steps of:

(g) finding the flow control device corresponding to the flow measuring device with the worst reading in the fluid system;

(h) sending signal to flow control device corresponding to the flow measuring device with the worst reading to close the flow control device at a set margin;

(i) reading the inputting information received from all flow measuring devices, and comparing the information with previous readings to determine if the system is stabilized after the adjustment of flow control devices and saving the readings of inputting information received from flow measuring devices in the HVAC operation database; repeating step (h) until the system is stabilized; and (j) going to the steps (f), until all readings of the flow measuring devices are within the acceptable margin of the design condition.

3. A method as claimed in claim 2, wherein the worst reading of the flow measuring device in the fluid system is determined by finding the maximum value of the difference of the reading from the flow measuring device with the value of the corresponding design condition divided by the value of the corresponding design condition.

4. A method as claimed in claim 2, wherein the set margins can be adjusted by the user.

5. A method as claimed in claim 2, wherein the set margins can be adjusted by preset rules.

6. A method as claimed in claim 2, wherein the fluid system is a Variable Air Volume system, wherein the control system further including more than one room temperature sensors for more than one temperature control zones, further comprising the steps of:

(k) reading all inputting information received from room temperature sensors of all zones and comparing the information with corresponding set points of each zones; and saving readings of all inputting information received from room temperature sensors in the HVAC operation database;

(l) if all the room temperature readings are lower than desired room temperatures exceeding set margin when the system is in cooling mode continuing to step (m);

if all the room temperature readings are higher than desired room temperatures exceeding set margin when the system is in heating mode, continuing to step (m);

if all the room temperature readings are higher than desired room temperatures exceeding set margin when the system is in cooling mode continuing to step (o);

if the all the room temperature readings are lower than desired room temperatures exceeding set margin when the system is in heating mode, continuing to step (o);

if all readings of the temperature sensors are within the acceptable margin of the set point, going to step (p);

(m) sending signal to control means to reduce speeds of fluid pressurizing devices;

(n) reading all inputting information received from temperature sensors, and comparing the information with previous readings to determine if the system is stabilized after the adjustment of speeds of fluid pressurizing devices; saving all readings of inputting information received from temperature sensors in the HVAC operation database; repeating step (n) until the system is stabilized, then going to step (k);

(o) sending signal to control means to increase speeds of fluid pressurizing devices; going to step (n);

(p) sending output to indicate the completion of the process.

7. A method as claimed in claim 6, wherein if some of the room temperature readings are higher than desired room temperatures exceeding set margin, and some of the room temperature readings are lower than desired room temperatures exceeding set margin, then:

(q) finding the flow control device corresponding to the room temperature sensor with the worst reading;

(r) if the worst reading is higher than desired room temperature in cooling mode, sending signal to flow control device corresponding to the room temperature sensor with the worst reading to open the flow control device at a set margin;

if the worst reading is lower than desired room temperature in cooling mode, sending signal to flow control device corresponding to the room temperature sensor with the worst reading to close the flow control device at a set margin;

if the worst reading is higher than desired room temperature in heating mode, sending signal to flow control device corresponding to the room temperature sensor with the worst reading to close the flow control device at a set margin;

if the worst reading is lower than desired room temperature in heating mode, sending signal to flow control device corresponding to the room temperature sensor with the worst reading to open the flow control device at a set margin;

(s) reading the inputting information received from all the room temperature sensors, and comparing the information with previous readings to determine if the system is stabilized after the adjustment of flow control devices and saving the readings of inputting information received from room temperature sensors in the HVAC operation database; repeating step (s) until the system is stabilized; and (t) going back to step (q), until all readings of the room temperature sensors are within the acceptable margin of the desired room temperatures.

8. A method as claimed in claim 7, wherein the worst reading of the room temperature sensor is determined by finding the maximum value of the difference of the reading from the room temperature sensor with the value of the corresponding desired room temperatures divided by the value of the corresponding desired room temperatures.

9. A method as claimed in claim 6, wherein the acceptable margin can be inputted by the users.

10. A method as claimed in claim 6, wherein the acceptable margin can be adjusted according preset rules.

11. A method as claimed in claim 2, wherein the fluid system is a chilled water system, wherein the control system further including more than one chilled water return temperature sensors, further comprising the steps of:

(k) reading all inputting information received from chilled water return temperature sensors and comparing the information with corresponding set points; and saving readings of all inputting information received from chilled water temperature sensors in the HVAC operation database;

(l) if all the chilled water return temperature readings are lower than set chilled water return temperatures exceeding set margin, continuing to step (m);

if all the chilled water return temperature readings are higher than set chilled water return temperatures exceeding set margin, continuing to step (o);

if all readings of the chilled water return temperature sensors are within the acceptable margin of the set point, going to step (p);

(m) sending signal to control means to reduce speeds of fluid pressurizing devices;

(n) reading all inputting information received from chilled water return temperature sensors, and comparing the information with previous readings to determine if the system is stabilized after the adjustment of speeds of fluid pressurizing devices; saving all readings of inputting information received from chilled water return temperature sensors in the HVAC operation database; repeating step (n) until the system is stabilized, then going to step (k);

(o) sending signal to control means to increase speeds of fluid pressurizing devices; going to step (n);

(p) sending output to indicate the completion of the process.

12. A method as claimed in claim 11, wherein if some of the chilled water return temperature readings are higher than desired chilled water return temperatures exceeding set margin, and some of the chilled water return temperature readings are lower than desired chilled water return temperatures exceeding set margin, then:

(q) finding the flow control device corresponding to the chilled water return temperature sensor with the worst reading;

(r) if the worst reading is higher than desired chilled water return temperature, sending signal to flow control device corresponding to the chilled water return temperature sensor with the worst reading to open the flow control device at a set margin;

if the worst reading is lower than desired chilled water return temperature, sending signal to flow control device corresponding to the chilled water return temperature sensor with the worst reading to close the flow control device at a set margin;

(s) reading the inputting information received from all the chilled water return temperature sensors, and comparing the information with previous readings to determine if the system is stabilized after the adjustment of flow control devices and saving the readings of inputting information received from chilled water return temperature sensors in the HVAC operation database; repeating step (s) until the system is stabilized; and (t) going back to step (q), until all readings of the chilled water return temperature sensors are within the acceptable margin of the desired chilled water return temperatures.

13. A method as claimed in claim 2, wherein the fluid system is a hot water system, wherein the control system further including more than one hot water return temperature sensors, further comprising the steps of:

(k) reading all inputting information received from hot water return temperature sensors and comparing the information with corresponding set points; and saving readings of all inputting information received from hot water temperature sensors in the HVAC operation database;

(l) if all the hot water return temperature readings are higher than set hot water return temperatures exceeding set margin, continuing to step (m);

if all the hot water return temperature readings are lower than set hotwater return temperatures exceeding set margin, continuing to step (o);

if all readings of the hot water return temperature sensors are within the acceptable margin of the set point, going to step (p);

(m) sending signal to control means to reduce speeds of fluid pressurizing devices;

(n) reading all inputting information received from hot water return temperature sensors, and comparing the information with previous readings to determine if the system is stabilized after the adjustment of speeds of fluid pressurizing devices; saving all readings of inputting information received from hot water return temperature sensors in the HVAC operation database; repeating step (n) until the system is stabilized, then going to step (k);

(o) sending signal to control means to increase speeds of fluid pressurizing devices; going to step (n);

(p) sending output to indicate the completion of the process.

14. A method as claimed in claim 13, wherein if some of the hot water return temperature readings are higher than desired hot water return temperatures exceeding set margin, and some of the hot water return temperature readings are lower than desired hot water return temperatures exceeding set margin, then:

(q) finding the flow control device corresponding to the hot water return temperature sensor with the worst reading;

(r) if the worst reading is lower than desired hot water return temperature, sending signal to flow control device corresponding to the hot water return temperature sensor with the worst reading to open the flow control device at a set margin;

if the worst reading is lower than desired hot water return temperature, sending signal to flow control device corresponding to the hot water return temperature sensor with the worst reading to close the flow control device at a set margin;

(s) reading the inputting information received from all the hot water return temperature sensors, and comparing the information with previous readings to determine if the system is stabilized after the adjustment of flow control devices and saving the readings of inputting information received from hot water return temperature sensors in the HVAC operation database; repeating step (s) until the system is stabilized; and (t) going back to step (q), until all readings of the hot water return temperature sensors are within the acceptable margin of the desired hot water return temperatures.

15. A method for operating a control system for a fluid system including at least one server, more than one flow measuring devices, more than one temperature sensors, more than one controllers for controlling more than one flow control devices, at least one control means to control at least one fluid pressurizing devices, and means for connecting the controllers and control means to the server, comprising the steps of:

(a) reading all inputting information received from temperature sensors and comparing the information with corresponding set points; and saving readings of all inputting information received from temperature sensors in the HVAC operation database;

(b) if all the temperature sensor readings are lower than desired temperatures exceeding set margin when the system is in cooling mode continuing to step (c);

if all the room temperature readings are higher than desired temperatures exceeding set margin when the system is in heating mode, continuing to step (c);

if all the temperature readings are higher than desired temperatures exceeding set margin when the system is in cooling mode continuing to step (e);

if the all the temperature readings are lower than desired temperatures exceeding set margin when the system is in heating mode, continuing to step (e);

if all readings of the temperature sensors are within the acceptable margin of the set point, going to step (f);

(c) sending signal to control means to reduce speeds of fluid pressurizing devices;

(d) reading all inputting information received from temperature sensors, and comparing the information with previous readings to determine if the system is stabilized after the adjustment of speeds of fluid pressurizing devices; saving all readings of inputting information received from temperature sensors in the HVAC operation database; repeating step (d) until the system is stabilized, then going to step (a);

(e) sending signal to control means to increase speeds of fluid pressurizing devices; going to step (d);

(f) sending output to indicate the completion of the process.

16. A method as claimed in claim 15, wherein if some of the temperature readings are higher than desired temperatures exceeding set margin, and some of the temperature readings are lower than desired temperatures exceeding set margin, then:

(g) finding the flow control device corresponding to the temperature sensor with the worst reading;

(h) if the worst reading is higher than desired temperature in cooling mode, sending signal to flow control device corresponding to the temperature sensor with the worst reading to open the flow control device at a set margin;

(i) if the worst reading is lower than desired temperature in cooling mode, sending signal to flow control device corresponding to the temperature sensor with the worst reading to close the flow control device at a set margin;

if the worst reading is higher than desired temperature in heating mode, sending signal to flow control device corresponding to the temperature sensor with the worst reading to close the flow control device at a set margin;

if the worst reading is lower than desired temperature in heating mode, sending signal to flow control device corresponding to the temperature sensor with the worst reading to open the flow control device at a set margin;

(j) reading the inputting information received from all the temperature sensors, and comparing the information with previous readings to determine if the system is stabilized after the adjustment of flow control devices and saving the readings of inputting information received from temperature sensors in the HVAC operation database; repeating step (s) until the system is stabilized; and (k) going back to step (g), until all readings of the temperature sensors are within the acceptable margin of the desired temperatures.

17. A control system for a HVAC system comprises a data intake module, a data storage module, a process module and a control module; wherein the data intake module receiving temperature readings from more than one temperature sensors;

the process module processing the temperature readings, and (l) finding the flow control device corresponding to the temperature sensor with the worst reading;

(m) if the worst reading is higher than desired temperature in cooling mode, the control module sending signal to a flow control device corresponding to the temperature sensor with the worst reading to open the flow control device at a set margin;

(n) if the worst reading is lower than desired temperature in cooling mode, the control module sending signal to flow control device corresponding to the temperature sensor with the worst reading to close the flow control device at a set margin;

if the worst reading is higher than desired temperature in heating mode, the control module sending signal to flow control device corresponding to the temperature sensor with the worst reading to close the flow control device at a set margin;

if the worst reading is lower than desired temperature in heating mode, the control module sending signal to flow control device corresponding to the temperature sensor with the worst reading to open the flow control device at a set margin; and (o) the data intake module reading the inputting information received from all the temperature sensors, and the process module comparing the information with previous readings to determine if the system is stabilized after the adjustment of flow control devices and the data storage module saving the readings of inputting information received from temperature sensors in the HVAC operation database; and the control system repeating the process until the system is stabilized; and (p) the control system repeat the process until all readings of the temperature sensors are within the acceptable margin of the desired temperatures.

18. A system as claimed in claim 17, wherein the worst reading of the temperature sensor is determined by finding the maximum value of the difference of the reading from the temperature sensor with the value of the corresponding desired temperatures divided by the value of the corresponding desired temperatures.

19. A method as claimed in claim 17, wherein the set margin can be inputted by the users.

20. A method as claimed in claim 17, wherein the set margin can be adjusted according preset rules.

* * * * *